US006443692B1

(12) United States Patent
Sakamoto et al.

(10) Patent No.: US 6,443,692 B1
(45) Date of Patent: Sep. 3, 2002

(54) IMPELLER FOR CIRCUMFERENTIAL CURRENT PUMP AND METHOD OF FORMING THE SAME

(75) Inventors: Yasuyuki Sakamoto; Naotaka Tatsuzawa; Yoichi Takeuchi, all of Kawaguchi (JP)

(73) Assignee: Enplas Corporation (JP)

( * ) Notice: Subject to any disclaimer, the term of this patent is extended or adjusted under 35 U.S.C. 154(b) by 24 days.

(21) Appl. No.: 09/697,935

(22) Filed: Oct. 27, 2000

(30) Foreign Application Priority Data

Oct. 28, 1999 (JP) ..... 11-306504

(51) Int. Cl.[7] ..... F04D 5/00
(52) U.S. Cl. ..... 415/55.1; 415/200
(58) Field of Search ..... 415/55.1, 55.2, 415/55.3, 55.4, 55.5, 55.6, 55.7, 200; 264/318, 328.1; 249/57, 59

(56) References Cited

U.S. PATENT DOCUMENTS 4,451,213 A 5/1984 Takei et al.
4,923,365 A * 5/1990 Rollwage ..... 415/119
5,429,476 A 7/1995 Krauter et al.

FOREIGN PATENT DOCUMENTS

DE 33 13 950 10/1983
DE 3313950 10/1983
JP 07151091 6/1995
JP 7-151091 * 6/1995
JP 9-158885 * 6/1997

OTHER PUBLICATIONS

Patent Abstracts of Japan, vol. 1998, No. 14, Dec. 31, 1998 & JP 10 259789A (Enplas Corp; Keihin Corp), Sep. 29, 1998.

Patent Abstracts of Japan, vol. 1995, No. 09, Oct. 31, 1995 & JP 07 151091A (Aisan Ind Co Ltd), Jun. 13, 1995.

* cited by examiner

*Primary Examiner*—Edward K. Look
*Assistant Examiner*—Kimya N. McCoy
(74) *Attorney, Agent, or Firm*—Bachman & LaPointe, P.C.

(57) ABSTRACT

An impeller for a circumferential current pump is injection molded and can be used as it is without being polished. The impeller (7) is provided with a plurality of vane grooves (12) on an outer periphery of a synthetic resin disc-like member (8) rotated by a motor, and is rotatably received with a substantially disc-like space (6) formed between a pump casing (4) and a pump cover (5). A disc-like recess portion (14) is formed in both side surfaces (10, 11) of the disc-like member (8). A formation is performed so that a ratio (L/2t) between the sum (t1+t2=2t) of a gap (t1) between one side surface (10) and the pump casing (4) and a gap (t2) between another side surface (11) and the pump cover (5), and a size (L=R0−H−R1) obtained by subtracting a radical groove length (H) of the vane groove (12) and a radial size (R1) of the recess portion (14) from a radial size (R0) of the disc-like member (8) satisfies a relation 66≦(L/2t).

20 Claims, 13 Drawing Sheets

IMPELLER FOR CIRCUMFERENTIAL CURRENT PUMP AND METHOD OF FORMING THE SAME

BACKGROUND OF THE INVENTION

1. Field of the Invention

The present invention relates to an impeller of a circumferential current pump (so-called "wesco pump") used as an in-tank type fuel pump of an automobile and a method of forming the impeller.

2. Description of the Prior Art

An in-tank type circumferential current pump having an improved property for being mounted to a vehicle and having a low noise and a small pressure change has been conventionally used in a fuel pump for an electronically controlled type fuel injection apparatus of an automobile.

FIGS. 23 to 25 show a circumferential current pump 51 for an automobile. The circumferential current pump 51 shown in these drawings is placed within a fuel tank (not shown), and is structured such as to apply an energy to a fuel by a vane 54 formed on an outer periphery of an impeller 52 when the impeller 52 is rotated by a motor 53 so as to increase a pressure of the fuel flowing into a pump flow passage 56 from a fuel inlet port 55 and discharge the fuel having the increased pressure to an engine side from a fuel discharge port 57.

In the circumferential current pump 51 mentioned above, in order to maintain a pump efficiency and a discharge pressure in a desired state, it is necessary to set gaps w1 and w2 in a side of side surfaces 58*a* and 58*b* of the impeller 52 within a predetermined size so as to reduce a leaked flow amount. Further, in the circumferential current pump 51 mentioned above, since the impeller 52 is always in contact with the fuel within the fuel tank, a phenol resin or a PPS resin excellent in a solvent resistance is used as a material for the impeller 52, whereby the impeller 52 is formed in a desired shape in accordance with an injection molding.

However, when using the injection molded impeller 52 as it is, the sizes of the gaps w1 and w2 on the side surfaces 58*a* and 58*b* of the impeller 52 do not satisfy a desirable accuracy due to a surface accuracy of the side surfaces 58*a* and 58*b* of the impeller 52, so that desired pump efficiency and discharge pressure can not be obtained.

Accordingly, in the conventional circumferential current pump 51, a width of the impeller 52 is finished at a high accuracy by polishing both of the side surfaces 58*a* and 58*b* of the injection molded synthetic resin impeller 52 and a surface accuracy of both of the side surfaces 58*a* and 58*b* of the impeller 52 is finished at a high accuracy. Therefore, the conventional impeller 52 has a disadvantage that a process and labor for working is much and a producing cost is increased (a first prior art).

Further, as shown in FIG. 26, there has been proposed an impeller 52 structured such as to reduce a resistance applied to both of the side surfaces 58*a* and 58*b* in comparison with the first prior art in which a whole of both of the side surfaces 58*a* and 58*b* forms a seal portion, by forming an annular recess 60 in both of the side surfaces 58*a* and 58*b*, forming a first seal portion S1 in an outer peripheral side thereof and forming a second seal portion S2 in an inner peripheral side thereof (refer to Japanese Unexamined Patent Publication No. 7-151091). However, since the impeller 52 is structured such that two seal portions S1 and S2 are formed in such a manner as to be apart from each other in a radial direction, it is necessary to polish both of the side surfaces 58*a* and 58*b* after the injection molding, in the same manner as that of the prior art mentioned above. Accordingly, the impeller 52 shown in FIG. 26 also has a disadvantage that a process and labor is much and a producing cost is increased in the same manner as that of the prior art mentioned above (a second prior art).

Accordingly, the applicant of the present invention proposed an invention structured such that a recess portion 61 is formed in a center portion of both of the side surfaces 58*a* and 58*b* of the impeller 52, a gate 62 for injection is arranged in the recess portion 61 and a pressure adjusting hole 63 is formed as shown in FIG. 27, whereby the injection molded impeller 52 can be used as it is without being polished (Japanese Unexamined Patent Publication No. 9-158885 (a third prior art)). However, in correspondence to a high performance of a fuel pump in recent years, it has been desired to provide an impeller having a higher accuracy.

SUMMARY OF THE INVENTION

Accordingly, an object of the present invention is to provide an impeller for a circumferential current pump which can solve the disadvantages in the prior arts mentioned above, and a method of forming the same.

In accordance with a first aspect of the present invention, there is provided an impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to the pump casing of the disc-like member and another side surface opposing to the pump cover. Further, the structure is characterized in that a ratio (L/2t) between the sum (t1+t2=2t) of a gap (t1) between the one side surface and the pump casing and a gap (t2) between the another side surface and the pump cover, and a size (L=R0−H−R1) obtained by subtracting a radial groove length (H) of the vane groove and a radial size (R1) of the recess portion from a radial size (R0) of the disc-like member satisfies a relation $66 \leqq (L/2t)$. In this case, the recess portion includes a substantially disc-like recess portion around a center of rotation of the disc-like member and a substantially annular recess portion around a center of rotation of the disc-like member.

In accordance with the present invention having the structure mentioned above, since it is possible to make the size (L) of the side surface functioning as a seal portion as small as possible, it is possible to form the side surface functioning as the seal portion at a high accuracy only in accordance with an injection molding. Therefore, in accordance with the present invention, a polishing of the impeller side surface is not required, so that it is possible to reduce a process and labor for producing the impeller. Further, in accordance with the present invention, as mentioned above, since it is possible to form the side surface functioning as the seal portion of the impeller at a high accuracy, it is possible to make the gap sizes (t1 and t2) smaller than those of the third prior art.

In accordance with a second aspect of the present invention, there is provided an impeller for a circumferential current pump which is provided with a plurality of vane grooves in an outer peripheral side of a synthetic resin disc-like member rotated by a motor and is rotatably received within a substantially disc-like space formed between a pump casing and a pump cover. Then, the impeller for the circumferential current pump is structured such that a recess portion having a predetermined radius around a center of rotation is formed on at least one of one side surface opposing to the pump casing of the disc-like member and another side surface opposing to the pump cover, and a plurality of grooves extending in a radial direction within the recess portion are formed in a radial shape.

In accordance with the present invention having the structure mentioned above, a plurality of grooves are formed in a radial shape so as to reduce a solid portion in the recess portion, whereby a cooling efficiency at a time of injection molding can be increased, a cycle time for the injection molding can be reduced, and a deformation of a whole of the impeller due to a molding shrinkage (sink mark). Further, in accordance with the present invention, since a plurality of grooves are formed in a radial shape as mentioned above and the solid portions between the grooves function as a rib, it is possible to reduce a weight without reducing a rigidity of the impeller and it is possible to reduce a used amount of the synthetic resin material.

In accordance with a third aspect of the present invention, there is provided an impeller for a circumferential current pump as recited in the second aspect mentioned above, wherein a ratio (L/2t) between the sum ($t1+t2=2t$) of a gap ($t1$) between the one side surface and the pump casing and a gap ($t2$) between the another side surface and the pump cover, and a size ($L=R0-H-R1$) obtained by subtracting a radial groove length (H) of the vane groove and a radial size ($R1$) of the recess portion from a radial size ($R0$) of the disc-like member satisfies a relation $66 \leqq (L/2t)$.

In accordance with the present invention having the structure mentioned above, it is possible to obtain the effects of the first aspect and the second aspect in a combined manner.

In accordance with a fourth aspect of the present invention, there is provided an impeller for a circumferential current pump as recited in any one of the first to third aspects, wherein a shape between the vane grooves on a side surface of the disc-like member is substantially rectangular.

In accordance with the present invention having the structure mentioned above, the impeller can be easily released from the mold after the injection molding, whereby it is possible to prevent an inferior mold release and prevent the impeller from being deformed together with the mold release.

In accordance with a fifth aspect of the present invention, there is provided an impeller for a circumferential current pump as recited in any one of the first to third aspects, wherein a shape of the vane groove on a side surface of the disc-like member is formed in such a manner as to expand a groove width from an inner portion in a radial direction toward an outer portion, and a shape between the vane grooves is formed in a substantially trapezoidal shape in which a width is reduced from the inner portion in the radial direction toward the outer portion.

In accordance with the present invention having the structure mentioned above, the impeller can be more easily released from the mold after the injection molding than the invention described in the fourth aspect, so that it is possible to further effectively prevent the inferior mold release and prevent the impeller from being deformed together with the mold release.

In accordance with a sixth aspect of the present invention, there is provided an impeller for a circumferential current pump as recited in any one of the first to fifth aspects, wherein a corner portion in a bottom portion of the vane groove is beveled.

In accordance with the present invention having the structure mentioned above, the impeller can be easily released from the mold after the injection molding, whereby it is possible to reduce a deformation of the impeller and an inferior mold release at a time of releasing from the mold.

In accordance with a seventh aspect of the present invention, there is provided an impeller for a circumferential current pump as recited in any one of the first to sixth aspects, wherein a pressure adjusting hole extending through the another side surface from the one side surface is formed at an inner position in a radial direction from a position at which a ring gate for the injection molding is arranged, within the recess portion.

In accordance with the present invention having the structure mentioned above, an injected synthetic resin material is smoothly supplied to a portion of the impeller in which a surface accuracy is required. Further, a pin for forming the pressure adjusting hole is arranged within a metal mold for the injection molding, whereby a surface rough portion together with a weld phenomenon is received within the recess portion even when the weld phenomenon is generated, so that the surface accuracy of the impeller side surface is not deteriorated.

In accordance with an eighth aspect of the present invention, there is provided a method of forming an impeller for a circumferential current pump in which a plurality of vane grooves are formed in an outer peripheral side of a synthetic resin disc-like member and a recess portion having a predetermined radius around a center of rotation is formed on at least one of one side surface of the disc-like member and another side surface thereof. Further, the structure is characterized in that a ring gate for an injection molding is arranged at a position corresponding to the recess portion and a synthetic resin is injected into a cavity from the ring gate.

In accordance with the present invention having the structure mentioned above, a burr generated at a time of cutting the ring gate is received within the recess portion of the impeller, so that a surface accuracy of the impeller side surface is not deteriorated and it is possible to injection mold an impeller having a high accuracy.

BRIEF DESCRIPTION OF THE DRAWINGS

FIGS. 4A and 4B are views for explaining an operating state of the circumferential current pump, in which FIG. 4A is a schematic plan view for explaining the operating state of the circumferential current pump and FIG. 4B is a cross sectional view along a line A—A in FIG. 4A;

FIGS. 7A and 7B are views showing a shape of a vane groove as seen from a side surface side of the impeller, in which FIG. 7A is a view of a shape of a first vane groove and FIG. 7B is a view of a shape of a second vane groove;

DESCRIPTION OF THE PREFERRED EMBODIMENTS

A description will be in detail given below of embodiments in accordance with the present invention with reference to the accompanying drawings.

First Embodiment

Figure 1:
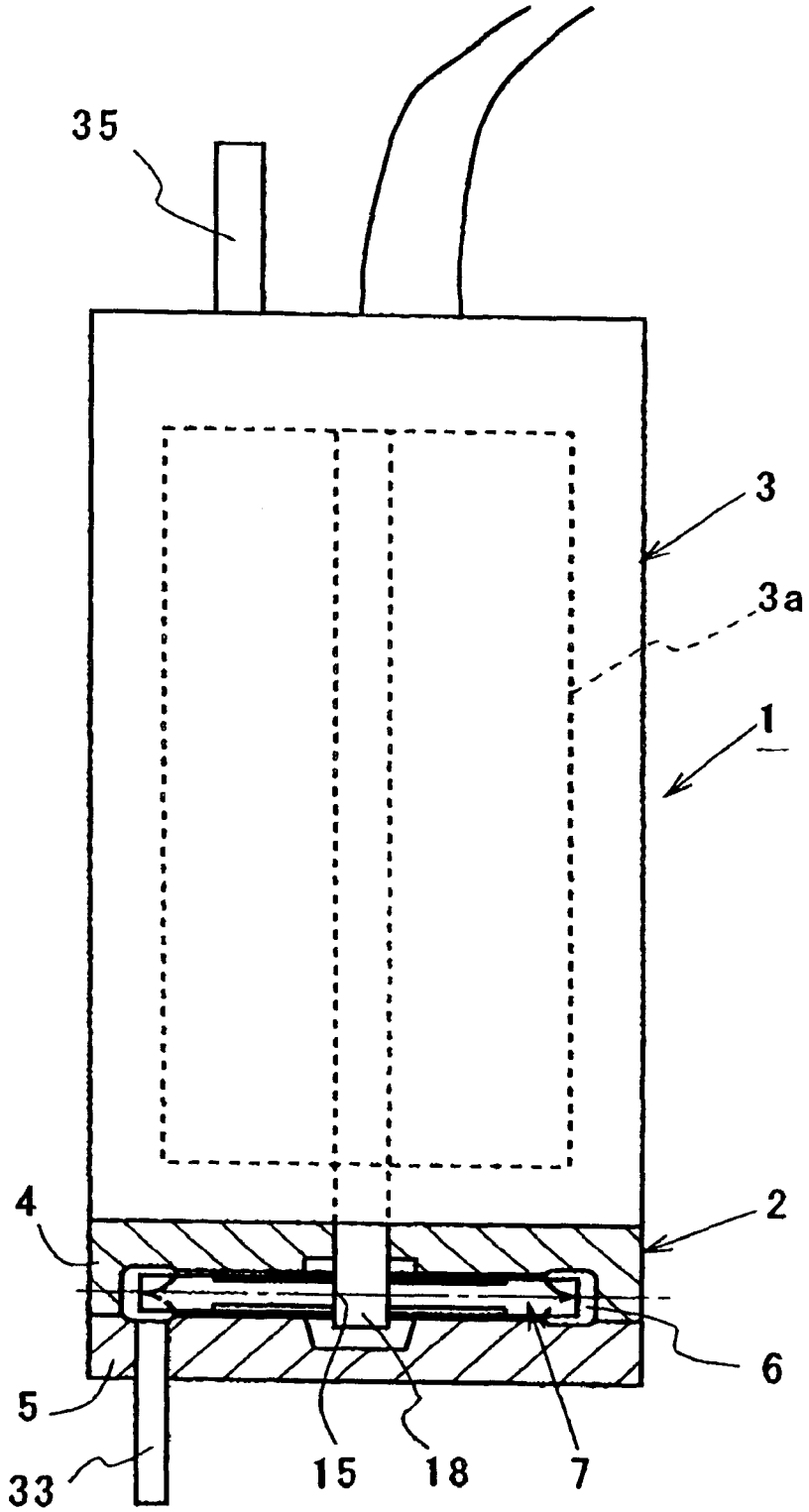
FIG. 1 is a front elevational view showing a part of a circumferential current pump in accordance with a first embodiment of the present invention in a broken manner.
Figure 2:
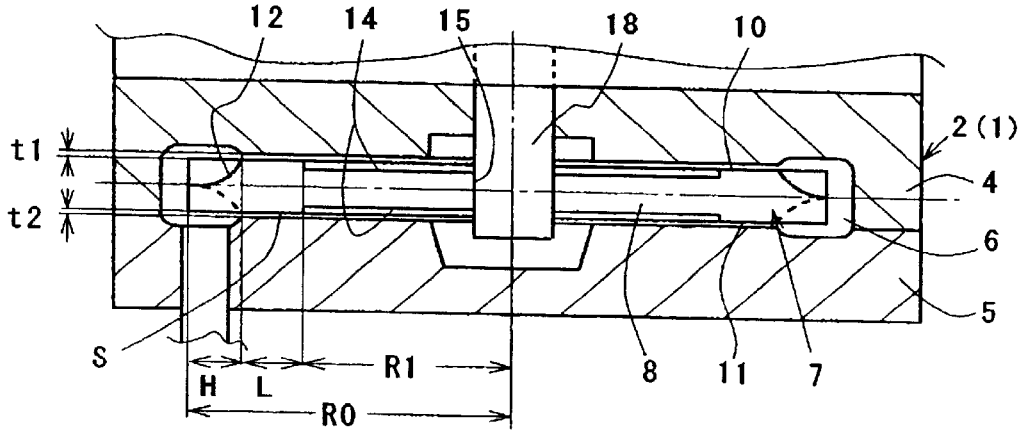
FIG. 2 is a view showing a part of FIG. 1 in an enlarged manner.

FIGS. 1 and 2 are views showing a circumferential current pump 1 in accordance with a first embodiment of the present invention. Among them, FIG. 1 is a front elevational view showing a part of the circumferential current pump 1 in a broken manner. Further, FIG. 2 is a cross sectional view showing a part of FIG. 1 in an enlarged manner.

As shown in these drawings, the circumferential current pump 1 in accordance with the present embodiment is constituted by a pump portion 2 and a motor portion 3. Among them, the pump portion 2 is provided with a pump casing 4 arranged in a lower end portion of the motor portion 3, a pump cover 5 assembled in a lower surface side of the pump casing 4, and a substantially disc-like impeller 7 rotatably received within a substantially disc-like space 6 formed between the pump casing 4 and the pump cover 5.

Since the impeller 7 is placed within a fuel tank (not shown), a phenol resin or a PPS resin excellent in a solvent resistance is used and the impeller 7 is formed in a desired shape in accordance with an injection molding.

The impeller 7 is structured such that a plurality of vane grooves 12 are formed in each of both side surfaces 10 and 11 in an outer peripheral end portion of a disc-like member 8 and vanes 13 between the vane grooves 12 and 12 are a half pitch shifted between one side surface 10 side and another side surface 11 side, as in detail shown in FIGS. 5, 6, 8 and 15. Further, a disc-like recess portion 14 having a predetermined radius around a center of rotation of the impeller 7 is formed in both side surfaces 10 and 11 of the impeller 7. Further, an axial hole 15 is formed in a center portion of the impeller 7, and a pressure adjusting hole 17 communicated with the recess portions 14 and 14 in both side surfaces 10 and 11 of the impeller 7 is formed near the axial hole 15. In this case, a rotation preventing portion 16 is engaged with a notch portion (not shown) of a motor drive shaft 18 so as to receive a drive force transmitted from the motor portion 3. Further, the pressure adjusting hole 17 is structured such as to balance a pressure applied to both side surfaces 10 and 11 of the impeller 7 so as to enable the impeller 7 to rotate in a state of being a little apart from the pump casing 4 and the pump cover 5. Further, the vane groove 12 of the impeller 7 is structured such that a shape in a side surface side and a shape in an outer peripheral side are formed in a substantially rectangular shape, and an inner end portion in a radial direction is cut up so as to form a substantially circular arc shape.

Figure 19:
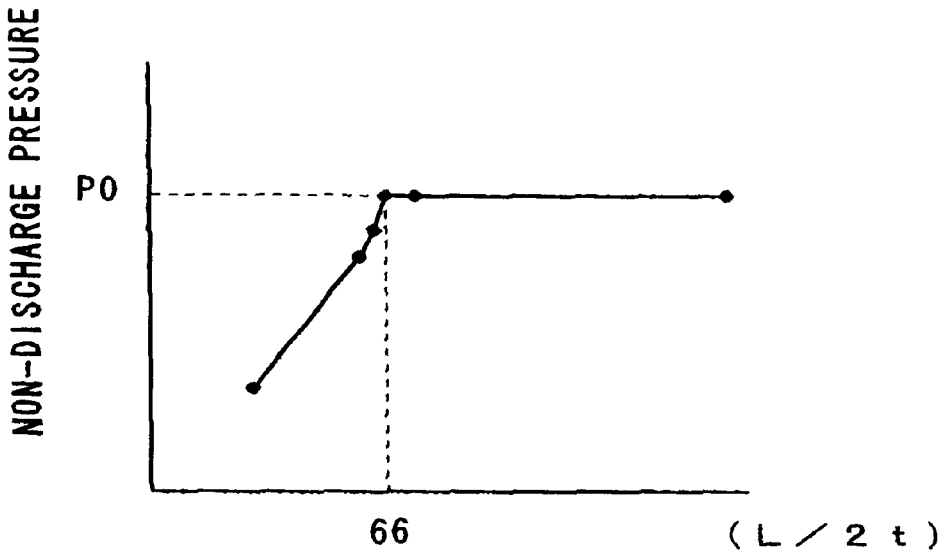
FIG. 19 is a graph showing a relation between a dimensionless amount (L/2t) and a no-discharge pressure.
Figure 20:
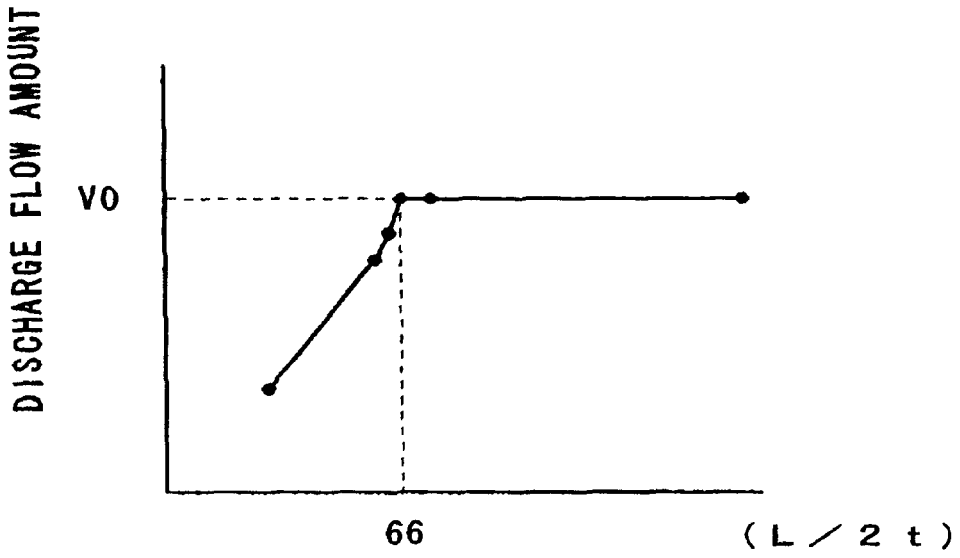
FIG. 20 is a graph showing a relation between the dimensionless amount (L/2t) and a discharge flow amount.

FIGS. 19 and 20 are graphs showing a relation between a radius of the recess portion 14 in the injection molded impeller 7 and a pump performance, that is, a relation between a size of a seal portion S and the pump performance (refer to FIG. 2). In these drawings, a horizontal axis corresponds to a dimensionless amount expressed by a rate between a size (L) of the seal portion and a gap (2t) of the impeller side surface. Further, a vertical axis in FIG. 19 corresponds to a no-discharge pressure and a vertical axis in FIG. 20 corresponds to a discharge flow amount. In this case, in FIG. 2, in the case of setting a gap between one side surface 10 of the impeller 7 and the pump casing 4 to t1 and setting a gap between another side surface 11 of the impeller 7 and the pump cover 5 to t2, the sum (2t) of the gaps in both side surfaces 10 and 11 of the impeller 7 is expressed by a formula (2t)=(t1)+(t2). Further, in the case of setting a radius of the disc-like member 8 to R0, setting a radius of the disc-like recess portion 14 to R1 and setting a radial groove length of the vane groove 12 to H, the size (L) of the seal portion S is expressed by a formula (L)=(R0)−(H)−(R1). Further, P0 in FIG. 19 is a non-discharge pressure required for a fuel pump and V0 in FIG. 20 is a discharge flow amount required for the fuel pump.

That is, FIG. 19 shows a relation between the value (L/2t) and the non-discharge pressure. A fuel can be discharged to an engine side at a substantially constant non-discharge pressure (P0) by setting the value so as to satisfy a relation $66 \leqq (L/2t)$. Further, FIG. 20 shows a relation between the value (L/2t) and the discharge flow amount. The fuel can be discharged at a substantially constant discharge flow amount (V0) by setting the value so as to satisfy the relation 66≦(L/2t) in the same manner as the relation between the value (L/2t) and the non-discharge pressure. Then, in accordance with the present embodiment, the sizes of the respective portions in the impeller 7 are set so as to satisfy a relation 66=(L/2t). As a result, it is possible to make the size L of the seal portion S smaller than the third prior art and it is possible to make the surface accuracy of the seal portion S higher than the third prior art. Accordingly, it is possible to use the injection molded impeller 7 as it is, and a polishing of both side surfaces 10 and 11 in the impeller 7 which is required in the first and second prior arts is not required.

Figure 11:
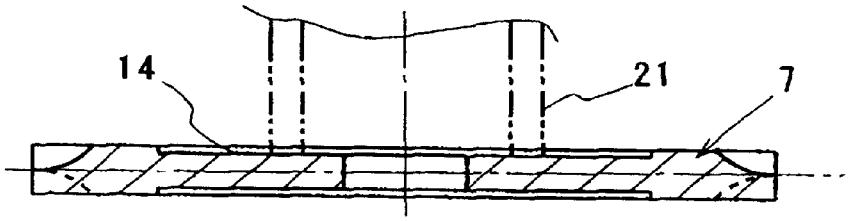
FIG. 11 is a cross sectional view showing a relation between the impeller and a ring gate (a cross sectional view along a line C—C in FIG. 12)
Figure 12:
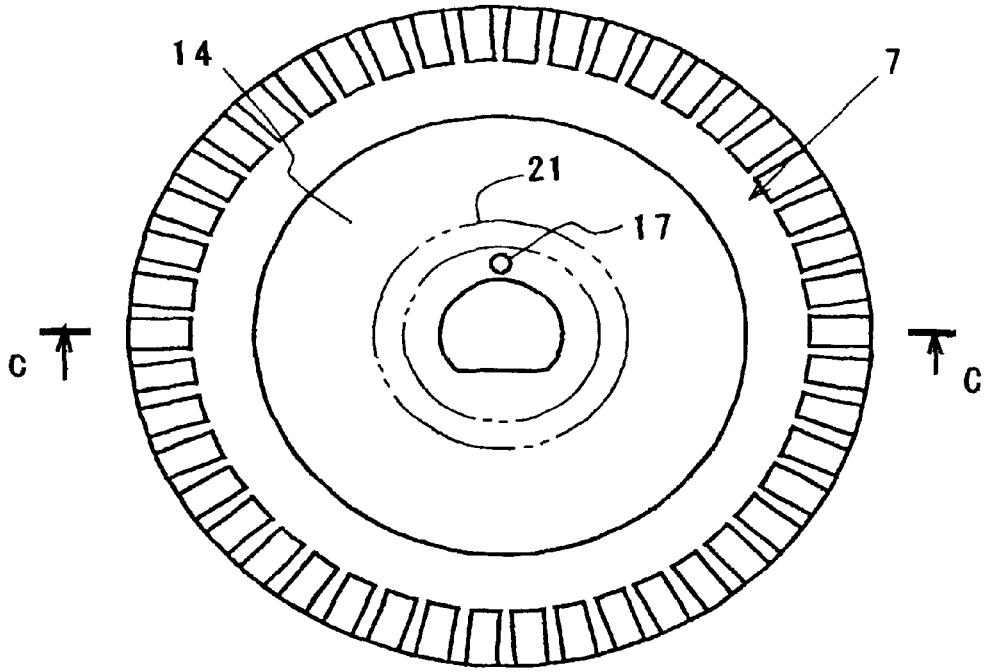
FIG. 12 is a plan view showing a relation between the impeller and the ring gate.
Figure 13:
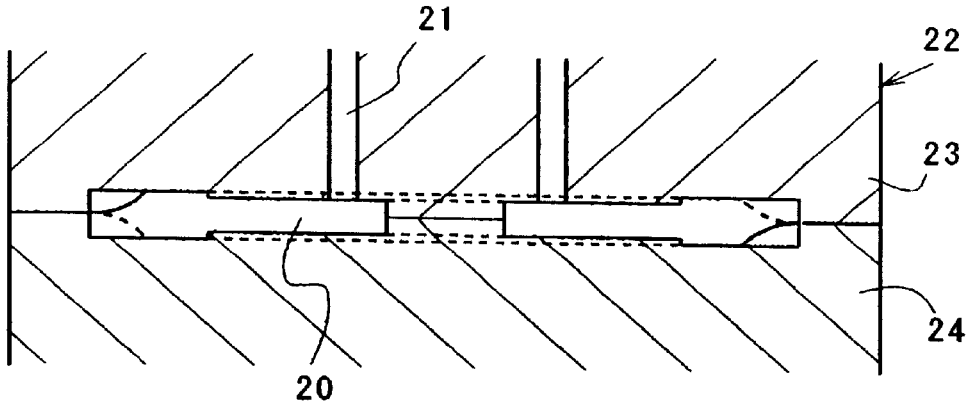
FIG. 13 is a cross sectional view showing a first example of an injection molding metal mold.
Figure 14:
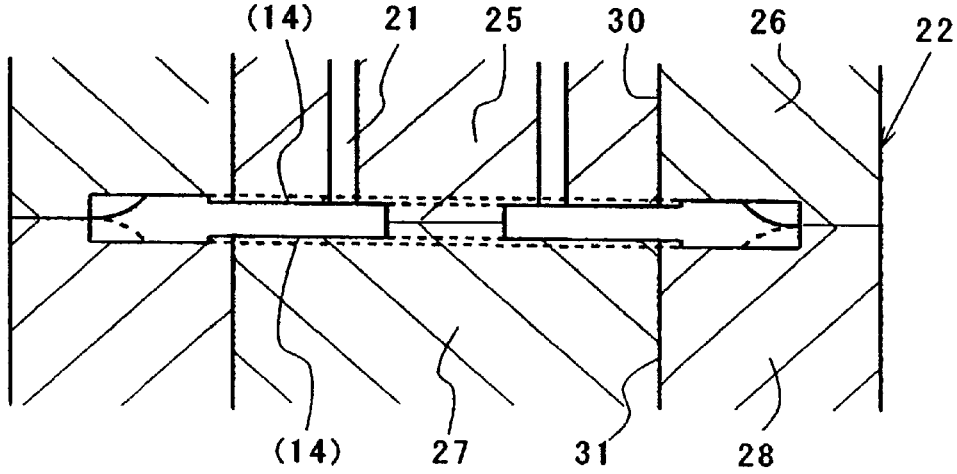
FIG. 14 is a cross sectional view showing a second example of the injection molding metal mold.
Figure 15:
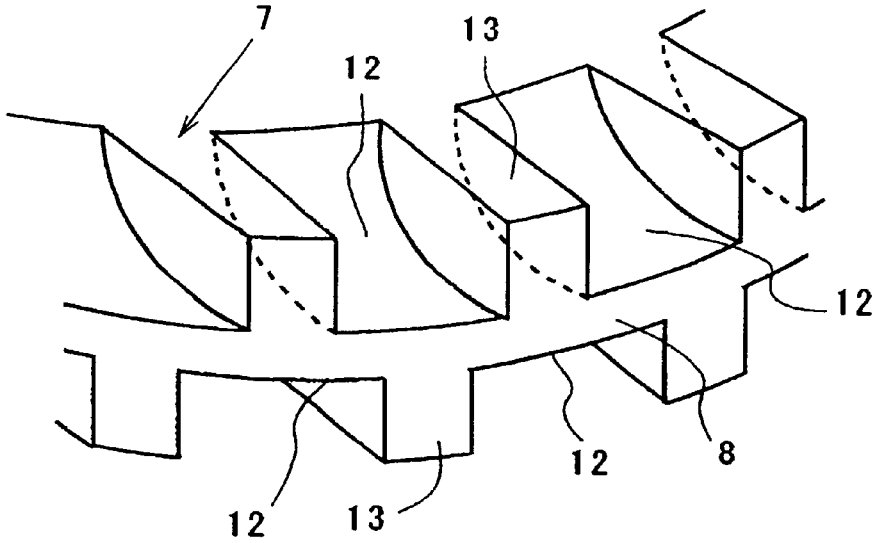
FIG. 15 is a perspective view partly showing an outer appearance of an outer peripheral end portion of the impeller.

FIGS. 11 to 13 show a method of forming the impeller 7. That is, the structure is made such that a ring gate 21 for injecting a synthetic resin within a cavity 20 for forming the impeller is arranged in a portion corresponding to the recess portion 14 of the impeller 7. In this case, FIG. 13 shows an example of an injection molding metal mold 22, the injection molding metal mold 22 is a two-separated metal mold comprising an upper die 23 and a lower die 24, and the cavity 20 for forming the impeller is formed on a joint surface between the upper die 23 and the lower die 24. Further, the ring gate 21 is formed in such a manner as to open to the cavity 20 corresponding to the recess portion 14 of the impeller 7 in the upper die 23. Further, FIG. 14 shows another example of the injection molding metal mold 22. The injection molding metal mold 22 is constituted by a first upper die 25 for forming the recess portion of the impeller 7, a second upper die 26 arranged in an outer peripheral side of the first upper die 25, a first low die 27 for forming the recess portion 14 of the impeller 7 and a second lower die 28 arranged in an outer peripheral side of the first lower die 27, a separation surface 30 between the first upper die 25 and the second upper die 26 and a separation surface 31 between the first lower die 27 and the second lower die 28 are positioned in the recess portion 14, and the ring gate 21 is formed in the first upper die 25. As mentioned above, in accordance with the present embodiment, the separation surfaces 30 and 31 of the injection molding metal mold 22 are positioned in the recess portion 14 and the ring gate 21 is positioned in the recess portion 14, whereby a burr and a surface rough portion generated on the separation surfaces 30 and 31 of the injection molding metal mold 22 and a released surface of the ring gate 21 are received within the recess portion 14, so that the surface accuracy of both side surfaces 10 and 11 (the seal portion S) in the impeller 7 is not deteriorated and a disadvantage that the gaps (t1 and t2) in the side of both side surfaces 10 and 11 of the impeller 7 are increased is not generated.

Figure 3:
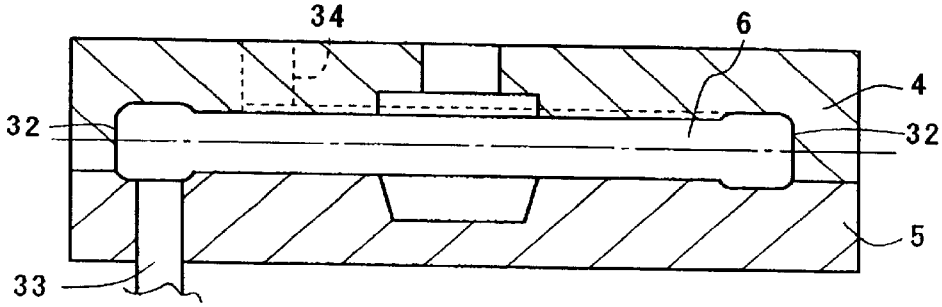
FIG. 3 is a cross sectional view showing a combined state between a pump casing and a pump cover.
Figure 4A:
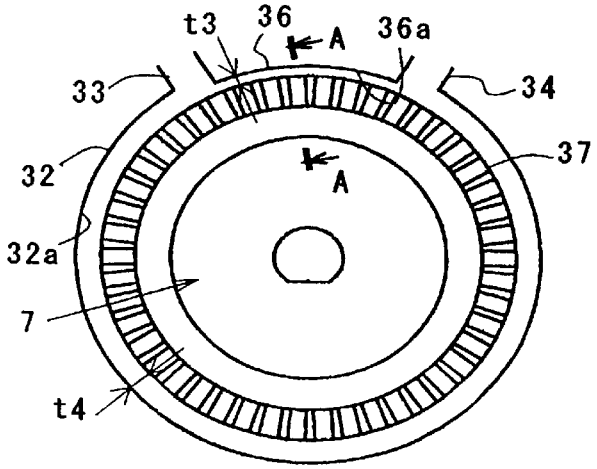
Figure 4B:
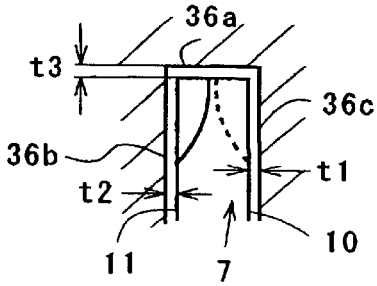
Figure 5:
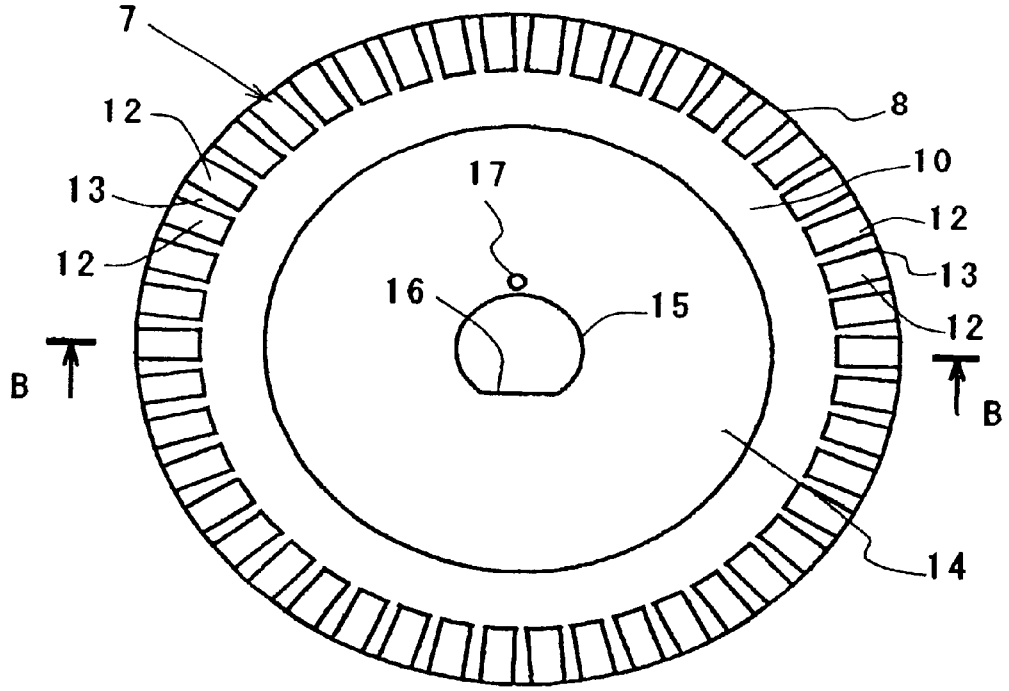
FIG. 5 is a side elevational view of an impeller.
Figure 6:
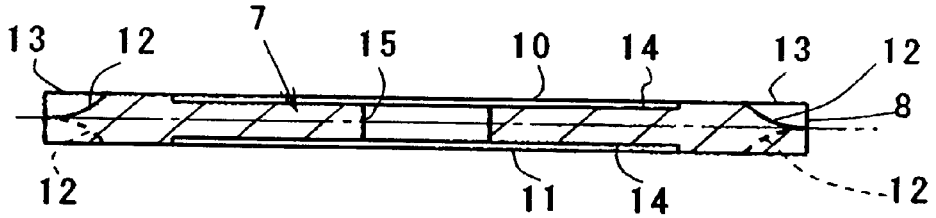
FIG. 6 is a cross sectional view along a line B—B in FIG. 5.

FIG. 3 is a view showing a combined state between the pump casing 4 and the pump cover 5. Further, FIG. 4 is a schematic view showing a relation among a pump flow passage 32, a fuel inlet port 33, a fuel outlet port 34 and the impeller 7. As shown in these drawings, the substantially disc-like space 6 for rotatably receiving the impeller 7 is formed on the joint surface between the pump casing 4 and the pump cover 5. Further, the fuel inlet port 33 of the pump cover 5 and the fuel output port 34 of the pump casing 4 are communicated with the pump flow passage 32 formed in an outer peripheral side of the disc-like space 6.

In accordance with the present embodiment having the structure mentioned above, as shown in FIGS. 1 and 4, when the impeller 7 is rotated and driven by a motor 3*a* of the motor portion 3, the fuel within the fuel tank (not shown) flows into the pump flow passage 32 from the fuel inlet port 33. Then, the fuel flowing into the pump flow passage 32 from the fuel inlet port 33 receives an energy from the rotating impeller 7 and a pressure of the fuel is increased by the impeller 7 while moving to the fuel outlet port 34 along the substantially annular pump flow passage 32. Then, the fuel having a sufficiently increased pressure passes through a flow passage (not shown) of the motor portion 3 from the fuel outlet port 34 and is supplied to the engine (not shown) from a fuel discharge port 35. In this case, as shown in FIG. 4, a partition wall portion 36 is formed between the fuel inlet port 33 and the fuel outlet port 34. A gap t3 between a peripheral surface 36*a* of the partition wall portion 36 and an outer peripheral surface 37 of the impeller 7 is set to be smaller than a gap t4 between a peripheral surface 32*a* of the pump flow passage 32 and the outer peripheral surface 37 of the impeller 7. Further, a gap between both side surfaces 36*b* and 36*c* of the partition wall portion 36 and both side surfaces 10 and 11 of the impeller 7 is set to a size equal to the gap size (t1 and t2) of the seal portion S in the impeller 7. That is, the gap in the side of the outer peripheral surface 37 of the impeller 7 and in the side of both side surfaces 10 and 11 is rapidly narrowed by the partition wall portion 36, whereby the fuel having the increased pressure is prevented from being leaked out to the fuel inlet port 33 side from the fuel outlet port 34 side. Further, the fuel within the pump flow passage 32 is prevented by the seal portion S of the impeller 7 from being leaked out inward in a radial direction.

As mentioned above, in accordance with the present embodiment, since the seal portion S is formed in a limited range in an inner peripheral side of the vane groove 12 at only one portion and a width of the seal portion S is short, the surface accuracy (a flatness, a total run-out tolerance in an axial direction, a surface roughness and the like) of the seal portion S is high even in the impeller 7 immediately after being injection molded, and a polishing of the impeller 7 is not required. Therefore, in accordance with the present embodiment, it is possible to reduce a process and labor for working the impeller 7 in comparison with the first prior art and the second prior art, so that it is possible to reduce a producing cost.

Further, in accordance with the present embodiment, it is possible to make the size L of the seal portion S in the impeller 7 smaller than the third prior art and it is possible to make the surface accuracy of the seal portion (on a side surface) S in the impeller 7 than the third prior art. Accordingly, the circumferential current pump 1 using the impeller 7 in accordance with the present embodiment can achieve a more excellent pump performance.

Further, in accordance with the present embodiment, since all of the inner side in the radial direction from the seal portion S in the impeller 7 corresponds to the recess portion 14 and a thickness of the impeller 7 is reduced, it is possible to accurately form the axial hole 15 with reducing an influence of a molding shrinkage (sink mark). Therefore, in accordance with the present embodiment, it can be expected that a rotating accuracy of the impeller 7 is improved and the pump performance is improved.

Figure 7A:
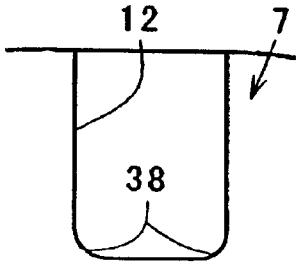
Figure 7B:
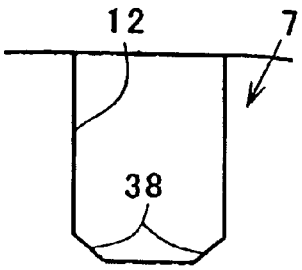
Figure 8:
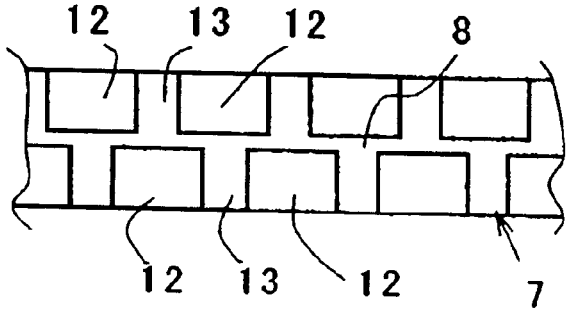
FIG. 8 is a view of a shape of the vane groove as seen from an outer peripheral surface side of the impeller.

In this case, in the present embodiment, as shown in FIG. 7, by beveling a corner portion in a bottom portion of the vane groove 12 in the impeller in an R surface (refer to FIG. 7A) and beveling in a C surface (refer to FIG. 7B), the impeller 7 can be easily released from the mold after the injection molding and a deformation of the impeller 7 at a time of releasing from the mold and an inferior mold release can be reduced.

Figure 9:
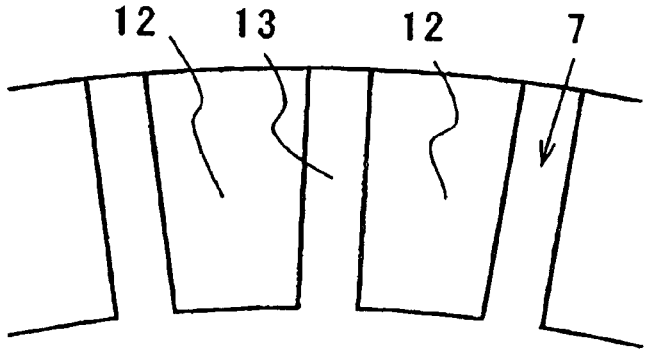
FIG. 9 is a view showing a first modified example of the shape of the vane groove as seen from a side surface side of the impeller.

Further, as shown in FIG. 9, by forming a shape in the side of the side surface of the vane groove 12 in a substantially trapezoidal shape and forming a shape in the side of the side surface of the vane 13 between the vane grooves 12 and 12 in a rectangular shape, the impeller 7 after the injection molding can be easily released from the mold and it is possible to prevent the inferior mold release and prevent the impeller 7 from being deformed together with the mold release. A size of the root portion of the vane 13 is largely changed when the root portion of the vane 13 is narrower than the front end portion in the outer peripheral side of the vane 13 since the vane 13 of the impeller 7 after the injection molding is structured such as to shrink toward a root portion thereof. This is because of preventing the disadvantage that the metal mold is held between the adjacent vanes 13 and 13, the impeller 7 is hard to be released from the injection molding metal mold 22 and the impeller 7 is deformed by a large force at a time of mold release from being generated due to the reason mentioned above (refer to FIGS. 13 and 14).

Figure 10:
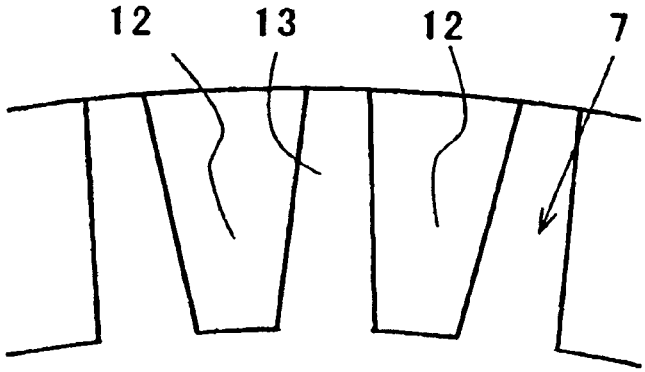
FIG. 10 is a view showing a second modified example of the shape of the vane groove as seen from a side surface side of the impeller.

Further, as shown in FIG. 10, by forming the shape in the side of the side surface of the vane groove 12 in a substantially trapezoidal shape and forming the shape in the side of the side surface of the vane 13 between the vane grooves 12 and 12 in a substantially trapezoidal shape having a width narrowed toward the front end, the impeller 7 can be more easily released from the mold after the injection molding than the aspect shown in FIG. 9.

Figure 16:
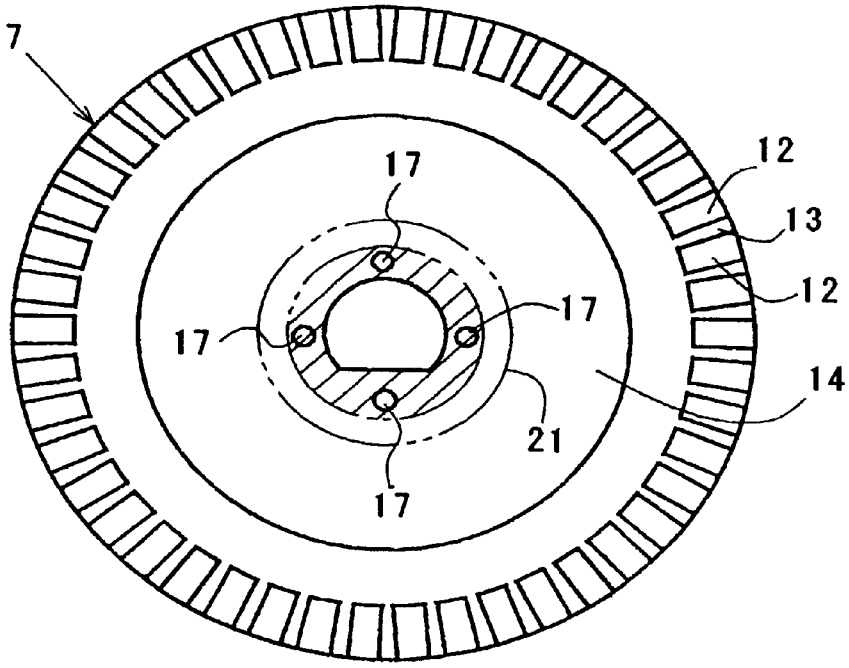
FIG. 16 is a side elevational view of the impeller showing another method of forming a pressure adjusting hole.

Further, as shown in FIG. 16, the pressure adjusting hole 17 may be positioned at any suitable positions as far as in an inner peripheral side of the ring gate 21 (in a hatched portion in FIG. 16) without being limited to the embodiment mentioned above. Further, the number of the pressure adjusting holes 17 is not limited to that of the embodiment mentioned above, and a plurality of pressure adjusting holes 17 may be formed. In accordance with the structure mentioned above, since the synthetic resin material injected from the ring gate 21 by the pin (not shown) for forming the pressure adjusting hole 17 arranged within the injection molding metal mold smoothly flows to an outer peripheral side (to the side of the seal portion S and the vane 13), and no weld phenomenon is generated to the outer peripheral side from the ring gate 21, the surface accuracy is not deteriorated together with the weld phenomenon. In this case, even if the weld phenomenon is generated in the periphery of the pressure adjusting hole in the inner peripheral side from the ring gate 21, the portion where the weld phenomenon is generated is within the recess portion 14 of the impeller 7, so that the pump performance is not deteriorated. In this case, the weld phenomenon means a line-like surface rough phenomenon generated at a time when the injected synthetic resin flow is brought into contact with the pin for forming the pressure adjusting hole 17 and branched and the branched synthetic resin flow is again combined in the downstream side of the pin.

Second Embodiment

Figure 17:
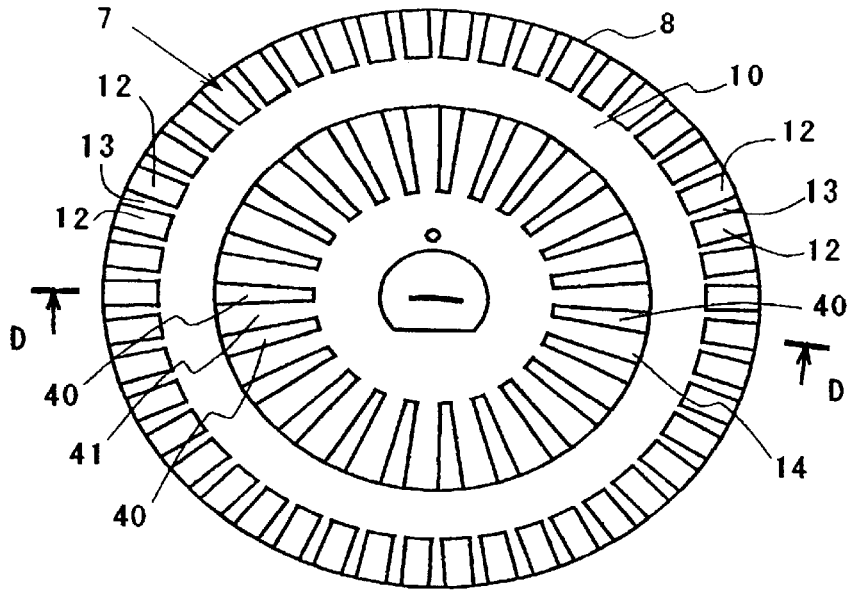
FIG. 17 is a side elevational view of an impeller showing a second embodiment in accordance with the present invention.
Figure 18:
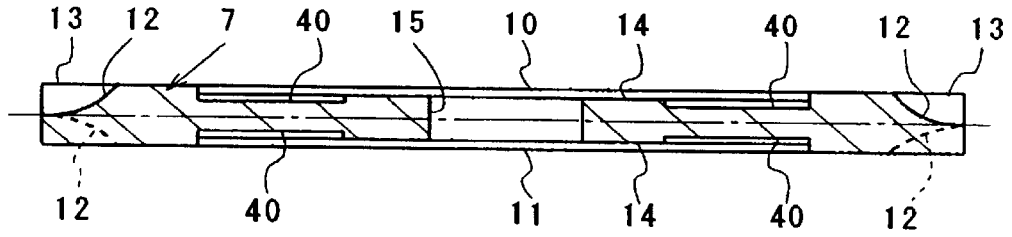
FIG. 18 is a cross sectional view along a line D—D in FIG. 17.

FIGS. 17 and 18 show a second embodiment in accordance with the present invention. In this case, in the present embodiment, the same reference numerals are attached to the same elements as those of the first embodiment mentioned above, and a description will be given in detail with omitting an overlapping description.

That is, in the present embodiment, a basic structure is the same as the first embodiment mentioned above, however, the present embodiment is different from the first embodiment in a point that a plurality of radially extending grooves 40 are formed in a radial shape.

Since the present embodiment structured in the manner mentioned above is the same as the first embodiment mentioned above in view of the basic structure, as mentioned above, the same effects as those of the first embodiment can be obtained.

Further, in the present embodiment, a plurality of grooves 40 are formed in a radial shape and the solid portion in the recess portion 14 is reduced, whereby a cooling efficiency at a time of injection molding is increased and a cycle time for injection molding is reduced, so that a produced number per a unit time is increased and a production efficiency of the impeller 7 is improved.

Further, in the present embodiment, as mentioned above, since a plurality of grooves 40 are formed in the recess portion 14, it is possible to reduce a used amount of the synthetic resin material and it is possible to reduce a weight, so that it is possible to further intend to reduce a producing cost of the impeller 7.

Further, in the present embodiment, since the radially left solid portion 41 between the grooves 40 and 40 functions as a rib by forming the groove 40 in a radial shape, it is possible to prevent a rigidity of the impeller 7 from being reduced as well as it is possible to reduce the weight of the impeller 7, so that it is possible to reduce a deformation of the impeller 7 generated at a protruding step in the injection molding.

Further, in the present embodiment, as mentioned above, since it is possible to locally reduce a thickness of the impeller 7 by forming a plurality of grooves 40 in a radial shape, it is possible to reduce a whole deformation of the impeller 7 due to a molding shrinkage (sink mark).

Third Embodiment

Figure 21:
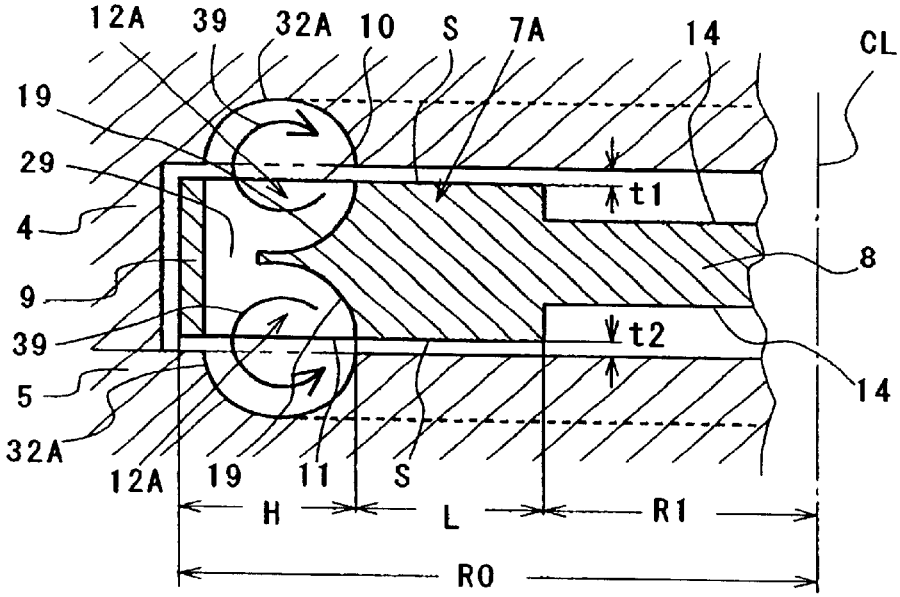
FIG. 21 is a partly enlarged cross sectional view of a circumferential current pump in accordance with a third embodiment of the present invention.
Figure 22:
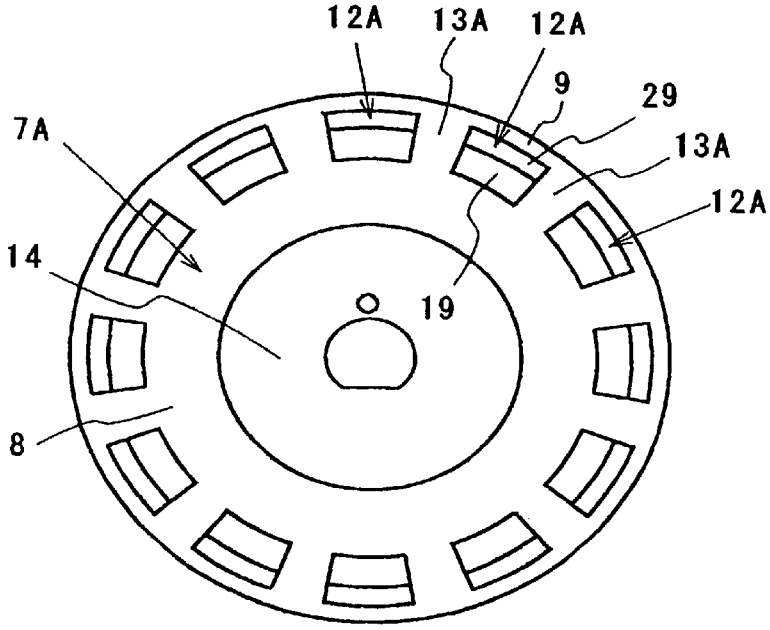
FIG. 22 is a front elevational view of an impeller for the circumferential current pump in accordance with the third embodiment of the present invention.
Figure 23:
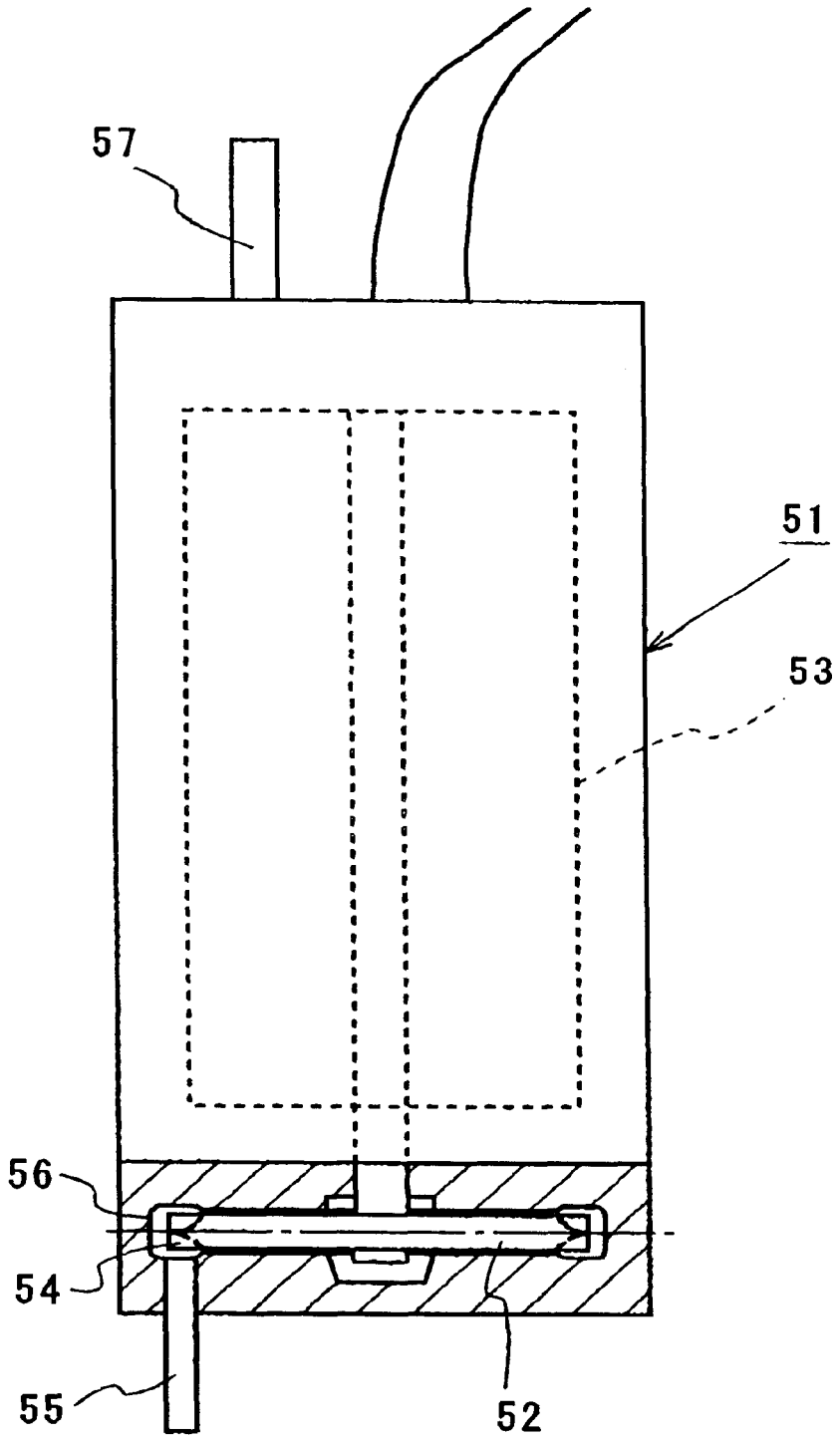
FIG. 23 PRIOR ART
FIG. 23 is a front elevational view showing a part of a conventional circumferential current pump in a broken manner.
Figure 24:
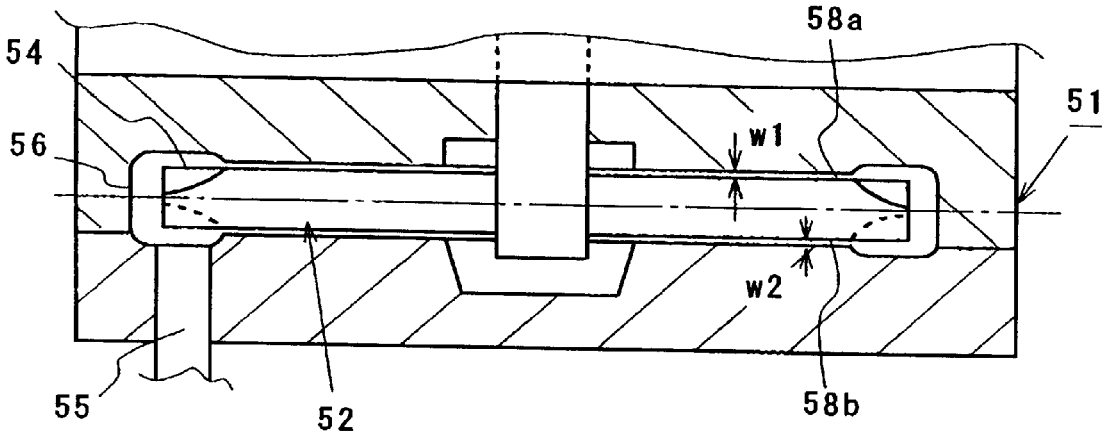
FIG. 24 PRIOR ART
FIG. 24 is a view showing a part of FIG. 21 in an enlarged manner.
Figure 25:
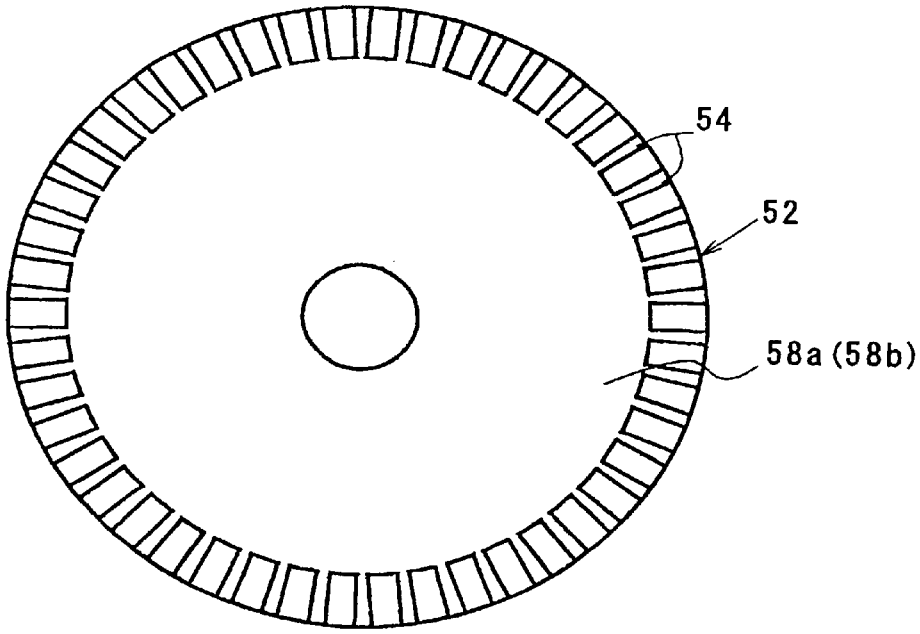
FIG. 25 PRIOR ART
FIG. 25 is a side elevational view of an impeller showing a first conventional embodiment.
Figure 26:
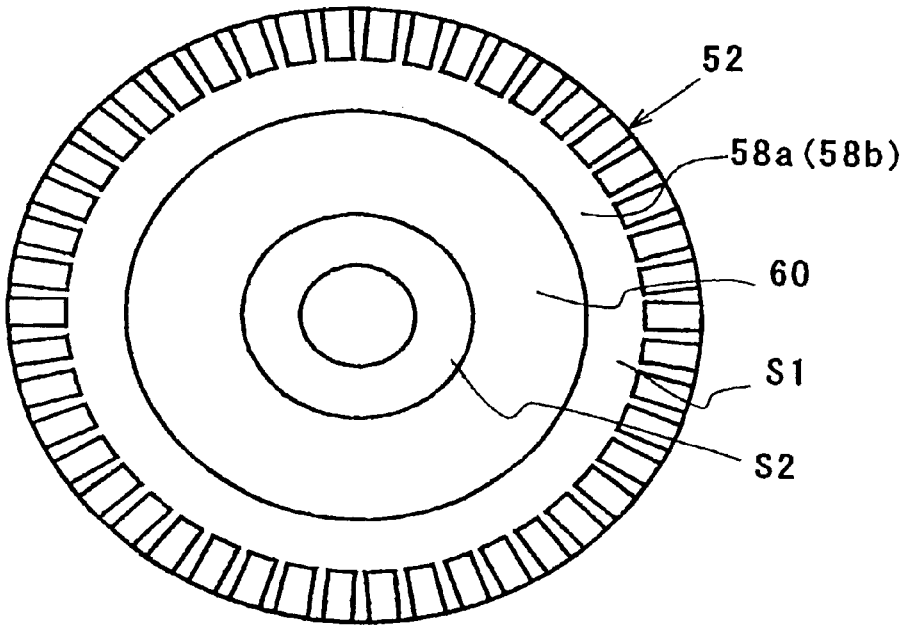
FIG. 26 PRIOR ART
FIG. 26 is a side elevational view of an impeller showing a second conventional embodiment.
Figure 27:
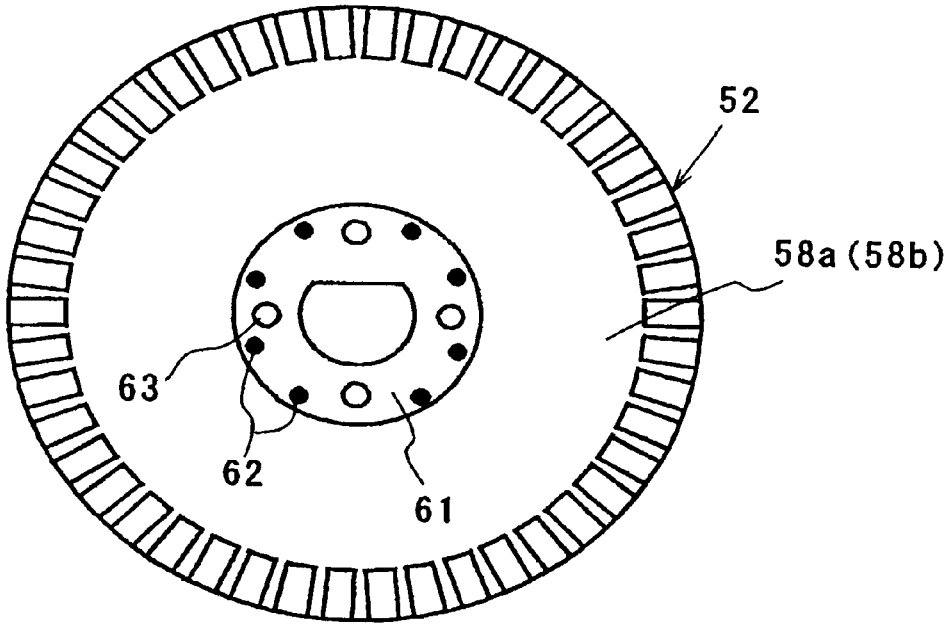
FIG. 27 PRIOR ART
FIG. 27 is a side elevational view of an impeller showing a third conventional embodiment.

FIGS. 21 and 22 show a third embodiment in accordance with the present invention. Among them, FIG. 21 is a partly enlarged cross sectional view of a circumferential current pump. Further, FIG. 22 is a front elevational view of an impeller 7A for the circumferential current pump.

In these drawings, the impeller 7A is structured such that a plurality of vane grooves 12A are formed in a peripheral direction of each of both side surfaces 10 and 11 in the outer peripheral side of the disc-like member 8. The vane groove 12A is constituted by an outer peripheral end wall 9, vanes 13A and 13A positioned at front and rear in a rotational direction of the disc-like member 8 and a circular arc-like wall portion 19 cut upward toward a radially inner direction of the disc-like member 8 so as to form a circular arc shape, and is structured such that the vane grooves 12A and 12A in the side of both side surfaces 10 and 11 are communicated with each other by an opening portion 29. Further, the impeller 7A is structured such that the substantially disc-like recess portion 14 is formed at a position in an inner side in a radial direction from the portion where the vane groove 12A of the disc-like member 8 is formed.

On the contrary, annular pump flow passage 32A and 32A formed in the pump casing 4 and the pump cover 5 in such a manner as to oppose to the vane groove 12A of the impeller 7A. The pump flow passage 32A is formed in a substantially semicircular shape in a cross section for generating a swirling current 39 as shown in FIG. 21. In this case, the pump flow passage 32A is communicated with a fuel inflow port (not shown) and a fuel outflow port (not shown).

In this case, in FIG. 21, a gap between one side surface 10 of the impeller 7A and the pump casing 4 is set to t1 and a gap between another side surface 11 of the impeller 7A and the pump cover 5 is set to t2. Then, the sum (2t) of the gaps of both side surfaces 10 and 11 of the impeller 7A is expressed by a formula (2t)=(t1)+(t2), in the same manner as the first embodiment mentioned above. Further, a radius of the disc-like member 8 is set to R0, a radius of the disc-like recess portion 14 is set to R1 and a radially groove length of the vane groove 12 is set to H. Then, a size (L) of the seal portion S is expressed by a formula (L)=(R0)−(H)−(R1), in the same manner as the first embodiment mentioned above. In this case, in FIG. 21, reference symbol CL denotes a center of rotation of the impeller 7A.

In the impeller 7A for the circumferential current pump in accordance with the present embodiment having the structure mentioned above, as a result of experimenting the relation between the value (L/2t) and the non-discharge pressure and the relation between the value (L/2t) and the discharge flow amount in the same manner as the first embodiment mentioned above, the same experimentation results as those in FIGS. 19 and 20 in accordance with the first embodiment can be obtained. That is, it is known that the present embodiment can discharge the fuel at the substantially constant non-discharge pressure and discharge flow amount by setting the values so as to satisfy the relation 66≦(L/2t), in the same manner as the first embodiment mentioned above.

Then, also in the present embodiment, the sizes of the respective portions in the impeller 7A are set so as to satisfy the relation 66=(L/2t). As a result, in accordance with the present embodiment, in the same manner as the first embodiment mentioned above, it is possible to make the size L of the seal portion S smaller than the third prior art and it is possible to make the surface accuracy of the seal portion S higher than the third prior art. Accordingly, the present embodiment can use the injection molded impeller 7A as it is in the same manner as the first embodiment mentioned above, and the polishing of both side surfaces 10 and 11 in the impeller 7A which is required in the first and second prior arts is not required, so that the same effects as those of the first embodiment can be obtained.

In this case, the radius (R1) of the recess portion 14 is not limited to each of the embodiments mentioned above and may be suitably set within a range 66≦(L/2t) by taking the surface accuracy of the seal portion S into consideration.

Further, in each of the embodiments mentioned above, the recess portion 14 is formed on both side surfaces 10 and 11 of the impellers 7 and 7A in a symmetrical manner, however, is not limited to this and may be formed on at least one side surface of both side surfaces 10 and 11 of the impellers 7 and 7A as far as the required pump performance is satisfied. Further, the recess portion 14 may be formed in a nonsymmetrical manner as far as the radius (R1) of the recess portion 14 satisfies a condition 66≦(L/2t). In addition, in each of the embodiments mentioned above, a boss portion which is not used as a seal portion may be formed in a substantially center portion of the disc-like member 8 (that is, a substantially center portion of the disc-like recess portion).

As mentioned above, the impeller in accordance with the present invention is formed so that the ratio (L/2t) between the sum (t1+t2=2t) of the gap (t1) between the one side surface and the pump casing and the gap (t2) between the another side surface and the pump cover, and the size (L=R0−H−R1) obtained by subtracting the radial groove length (H) of the vane groove and the radial size (R1) of the recess portion from the radial size (R0) of the disc-like member satisfies the relation 66≦(L/2t), whereby it is possible to make the size (L) of the side surface functioning as the seal portion as small as possible, so that it is possible to form the side surface functioning as the seal portion at a high accuracy only in accordance with an injection molding. Therefore, in accordance with the present invention, a polishing of the impeller side surface is not required, so that it is possible to reduce a process and labor for producing the impeller. Accordingly, it is possible to intend to reduce the producing cost of the impeller.

Further, in accordance with the present invention, as mentioned above, since it is possible to form the side surface functioning as the seal portion of the impeller at a high accuracy, it is possible to make the gap sizes (t1 and t2) smaller than those of the third prior art, so that it is possible to improve a performance of the circumferential current pump using the impeller in accordance with the present invention.

What is claimed is:

1. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, and wherein a ratio (L/2t) between the sum (t1+t2=2t) of a gap (t1) between said one side surface and said pump casing and a gap (t2) between said another side surface and said pump cover, and a size (L=R0−H−R1) obtained by subtracting a radial groove length (H) of said vane groove and a radial size (R1) of said recess portion from a radial size (R0) of said disc-like member satisfies a relation 66≦(L/2t).

2. An impeller for a circumferential current pump as claimed in claim 1, wherein a shape between said vane grooves on a side surface of said disc-like member is substantially rectangular.

3. An impeller for a circumferential current pump as claimed in claim 1, wherein a pressure adjusting hole extending through said another side surface from said one side surface is formed at an inner position in a radial direction from a position at which a ring gate for the injection molding is arranged, within said recess portion.

4. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, and a plurality of grooves each extending in a radial direction are radially formed within the recess portion.

5. An impeller for a circumferential current pump as claimed in claim 4, wherein a ratio (L/2t) between the sum (t1+t2=2t) of a gap (t1) between said one side surface and said pump casing and a gap (t2) between said another side surface and said pump cover, and a size (L=R0−H−R1) obtained by subtracting a radial groove length (H) of said vane groove and a radial size (R1) of said recess portion from a radial size (R0) of said disc-like member satisfies a relation 66≦(L/2t).

6. An impeller for a circumferential current pump as claimed in claim 4, wherein a shape between said vane grooves on a side surface of said disc-like member is substantially rectangular.

7. An impeller for a circumferential current pump as claimed in claim 4, wherein a pressure adjusting hole extending through said another side surface from said one side surface is formed at an inner position in a radial direction from a position at which a ring gate for the injection molding is arranged, within said recess portion.

8. A method of forming an impeller for a circumferential current pump in which a plurality of vane grooves are formed in an outer peripheral side of a synthetic resin disc-like member and a recess portion having a predetermined radius around a center of rotation is formed on at least one of one side surface of the disc-like member and another side surface thereof, wherein a ring gate for an injection molding is arranged at a position corresponding to said recess portion and a synthetic resin is injected into a cavity from the ring gate.

9. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, wherein a ratio (L/2t) between the sum (t1+t2=2t) of a gap (t1) between said one side surface and said pump casing and a gap (t2) between said another side surface and said pump cover, and a size (L=R0−H−R1) obtained by subtracting a radial groove length (H) of said vane groove and a radial size (R1) of said recess portion from a radial size (R0) of said disc-like member satisfies a relation 66≦(L/2t), and wherein a shape of said vane groove on a side surface of said disc-like member is formed in such a manner as to expand a groove width from an inner portion in a radial direction toward an outer portion, and a shape between the vane grooves is formed in a substantially trapezoidal shape in which a width is reduced from the inner portion in the radial direction toward the outer portion.

10. An impeller for a circumferential current pump as claimed in claim 9, wherein a corner portion in a bottom portion of said vane groove is beveled.

11. An impeller for a circumferential current pump as claimed in claim 9, wherein a pressure adjusting hole extending through said another side surface from said one side surface is formed at an inner position in a radial direction from a position at which a ring gate for the injection molding is arranged, within said recess portion.

12. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, and a plurality of grooves extending in a radial direction within the recess portion are formed in a radial shape, and wherein a shape of said vane groove on a side surface of said disc-like member is formed in such a manner as to expand a groove width from an inner portion in a radial direction toward an outer portion, and a shape between the vane grooves is formed in a substantially trapezoidal shape in which a width is reduced from the inner portion in the radial direction toward the outer portion.

13. An impeller for a circumferential current pump as claimed in claim 12, wherein a corner portion in a bottom portion of said vane groove is beveled.

14. An impeller for a circumferential current pump as claimed in claim 12, wherein a pressure adjusting hole extending through said another side surface from said one side surface is formed at an inner position in a radial direction from a position at which a ring gate for the injection molding is arranged, within said recess portion.

15. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, wherein a ratio (L/2t) between the sum (t1+t2=2t) of a gap (t1) between said one side surface and said pump casing and a gap (t2) between said another side surface and said pump cover, and a size (L=R0−H−R1) obtained by subtracting a radial groove length (H) of said vane groove and a radial size (R1) of said recess portion from a radial size (R0) of said disc-like member satisfies a relation 66≦(L/2t), and wherein a corner portion in a bottom portion of said vane groove is beveled.

16. An impeller for a circumferential current pump as claimed in claim 15, wherein a shape between said vane grooves on a side surface of said disc-like member is substantially rectangular.

17. An impeller for a circumferential current pump as claimed in claim 15, wherein a pressure adjusting hole extending through said another side surface from said one side surface is formed at an inner position in a radial direction from a position at which a ring gate for the injection molding is arranged, within said recess portion.

18. An impeller for a circumferential current pump which is provided with a plurality of vane grooves in an outer peripheral side of a synthetic resin disc-like member rotated by a motor and is rotatably received within a substantially disc-like space formed between a pump casing and a pump cover, wherein a recess portion having a predetermined radius around a center of rotation is formed on at least one of one side surface opposing to said pump casing of said disc-like member and another side surface opposing to said pump cover, and a plurality of grooves extending in a radial direction within the recess portion are formed in a radial shape, and wherein a corner portion in a bottom portion of said vane groove is beveled.

19. An impeller for a circumferential current pump as claimed in claim 18, wherein a shape between said vane grooves on a side surface of said disc-like member is substantially rectangular.

20. An impeller for a circumferential current pump as claimed in claim 18, wherein a pressure adjusting hole extending through said another side surface from said one side surface is formed at an inner position in a radial direction from a position at which a ring gate for the injection molding is arranged, within said recess portion.

* * * * *